United States Patent [19]

Benen

[11] Patent Number: 4,903,903

[45] Date of Patent: Feb. 27, 1990

[54] MOBILE CRUSHING PLANT

[75] Inventor: Günther Benen, Münster, Fed. Rep. of Germany

[73] Assignee: Salzgitter Maschinenbau GmbH, Salzgitter-Bad, Fed. Rep. of Germany

[21] Appl. No.: 326,468

[22] Filed: Mar. 21, 1989

Related U.S. Application Data

[63] Continuation of Ser. No. 116,466, Nov. 3, 1987, abandoned.

[30] Foreign Application Priority Data

Nov. 3, 1986 [DE] Fed. Rep. of Germany ..... 3637389

[51] Int. Cl.[4] ..... B02C 21/02

[52] U.S. Cl. ..... 241/101.7; 241/285 R; 241/285 B

[58] Field of Search ..... 241/101.7, 101.2, 285 R, 241/285 A, 285 B

[56] References Cited

U.S. PATENT DOCUMENTS

| | | | |
|---|---|---|---|
| 4,383,651 | 5/1983 | Couperus | 241/101.7 X |
| 4,585,179 | 4/1986 | Tsuji et al. | 241/101.7 |
| 4,655,402 | 4/1987 | Desourdy | 241/101.7 X |

*Primary Examiner*—Joseph M. Gorski

*Attorney, Agent, or Firm*—Peter K. Kontler

[57] ABSTRACT

A mobile crushing plant has an elongated frame with a front end portion connectable to a towing vehicle and a rear end portion supporting a comminuting machine which receives material to be crushed from a feeding unit having an inlet above the front end portion of the frame. When the plant is in use, the front end portion is detached from the towing vehicle and a first set of jacks in front of a pair of normally ground-contacting wheels is lowered into contact with the ground. A second set of jacks behind the wheels is then extended to lift the rear end portion by pivoting the frame about the lower end of the first set of jacks so that the inlet of the feeding unit is moved nearer to the ground and the comminuting machine is lifted above and away from the ground. A portion of the feeding unit is substantially horizontal when the front end portion of the frame is attached to the vehicle or when the crushing plant is in use.

4 Claims, 1 Drawing Sheet

MOBILE CRUSHING PLANT

This application is a continuation, of application Ser. No. 116,466, filed Nov. 3, 1987 now abandoned.

BACKGROUND OF THE INVENTION

The invention relates to improvements in so-called mobile crushing plants which can be transported to and from locations where large quantities of building and/or other material must be crushed and, if necessary, classified according to size and/or other characteristics. Mobile crushing plants are manufactured by the assignee of the present application, and some of presently popular plants are known as Krokodil and Kaiman. Reference may be had to a publication entitled "Mobile Crushing and Screening Plant" which is distributed by the assignee.

It is already known to design the frame of a mobile crushing plant in such a way that one of its ends can be hitched to a towing vehicle, e.g., to a flat bed truck, and that the frame carries a comminuting machine as well as a feeding unit which serves to supply material to be crushed into the range of the comminuting machine. The frame and its wheels resemble a semitrailer. One end of the frame carries the comminuting machine and the other end of the frame serves as a means for supporting the inlet of the material feeding unit.

When a mobile crushing plant is in actual use, it is desirable to maintain the inlet of the material feeding unit as close to the ground as possible. Reference may be had to German Offenlegungsschrift No. 32 28 735 which discloses a mobile crushing plant with a frame serving to support a tiltable material feeding unit. When the frame is detached from a towing vehicle, the inlet of the feeding unit is tilted to a lower or lowermost level at a short distance above the ground. A drawback of the crushing plant which is disclosed in this printed publication is that the outlet in the lowermost portion of the comminuting machine is close to the respective portion of the frame and the frame is rather close to the ground so that it is not possible to move the receiving end of a standard take-off conveyor for comminuted material to a position for reception of material from the comminuting machine. The rear end portion of the frame cannot be raised or provided with a platform for the comminuting machine because this would move the machine to a level above that which is permissible for transport of the crushing plant on public roads. The just discussed publication proposes to provide a duct in the rear portion of the frame in order to establish a path for evacuation of comminuted material onto a conveyor in the frame. Such solutions cannot be resorted to in all kinds of crushing plants.

German Utility Model No. 85 34 877 proposes a different mobile crushing plant wherein the understructure of the endless conveyor of the material feeding unit constitutes the frame of a semitrailer and is located at a level below a crushing roll. The rear end portion of the frame is mounted on a set of wheels and supports the crushing roll. The rear end portion of the frame further carries lifting means serving to pivot the frame about a transversely extending horizontal axis so that the front end portion of the frame comes to rest on the ground. The comminuting machine is located above the axis so that its level does not change when the frame is tilted in order to lower its front end portion into contact with the ground.

German Pat. No. 31 10 444 discloses a mobile crushing plant wherein the entire frame can be lifted above the ground. Such lifting of the frame also entails a lifting of the wheels, and each portion of the frame is raised to the same extent. This solves the problem of raising the comminuting machine so as to provide room for a take-off conveyor beneath the outlet of the machine. However, the inlet of the material feeding unit is normally located at a level well above the ground. Therefore, it is necessary to provide discrete tilting means for the material feeding unit.

OBJECTS AND SUMMARY OF THE INVENTION

An object of the invention is to provide a novel and improved mobile crushing plant which is constructed and assembled in such a way that the comminuting machine can be moved to an optimum position for operation simultaneously with a movement of the material feeding unit to an optimum position.

Another object of the invention is to provide a crushing plant wherein a single tilting apparatus suffices to ensure a movement of the comminuting machine and of the material feeding unit to optimum positions for operation or to optimum positions for transport by a towing vehicle.

A further object of the invention is to provide a novel and improved frame for use in the above outlined mobile crushing plant.

An additional object of the invention is to provide the crushing plant with novel and improved means for stabilizing its frame in actual use and to construct the stabilizing means in such a way that it can perform additional important and useful functions.

Still another object of the invention is to provide a mobile crushing plant wherein the comminuting machine affords ample room to place a take-off conveyor beneath its outlet when the crushing plant is in actual use.

A further object of the invention is to provide a plant of the just outlined character wherein a single tilting of the frame suffices to raise the comminuting machine to an optimum level while simultaneously lowering the inlet of the material feeding unit as close to the ground as possible.

The invention is embodied in a mobile crushing plant which comprises a preferably elongated frame having a first portion (particularly an end portion) which is connectable with a towing vehicle and a second portion (particularly an end portion), at least one set of ground-contacting wheels mounted on the frame, a comminuting machine which is mounted on the frame in the region of one of the portions, means for feeding material to be crushed to the comminuting machine including an inlet provided on the frame in the region of the other portion (or directly above or even beyond the other portion of the frame), a fulcrum provided for the frame between the inlet and the machine and defining for the frame an at least substantially horizontal pivot axis which extends transversely of the frame and is or can be located at or in immediate or close proximity to the ground, and means for raising and lowering the one portion of the frame to thereby pivot the frame about the axis between a first position in which the inlet and the comminuting machine are located at first distances from the ground and a second position in which the inlet is located at a lesser second distance and the comminuting machine is located at a greater second distance from the ground.

The fulcrum is preferably movably (especially extendably and retractibly) mounted on the frame so that it can be moved into and from contact with the ground. For example, the frame can carry a set of jacks which can be actuated to move their lower ends into and from contact with the ground, and such lower ends of the jacks then constitute the aforementioned fulcrum. The fulcrum is preferably immediately or closely adjacent one side of the at least one set of wheels at a considerable distance from the inlet of the feeding means, and the lifting and lowering means is preferably immediately or closely adjacent the other side of the at least one set of wheels.

The feeding means, or at least that component of the feeding means which is immediately adjacent the intake end of the comminuting machine, is preferably horizontal or nearly horizontal in one position of the frame. For example, a conveyor of the feeding means can be substantially horizontal in the first position of the frame, and a sieve between the conveyor of the feeding means and the machine can be substantially horizontal in the second position of the frame.

The novel features which are considered as characteristic of the invention are set forth in particular in the appended claims. The improved crushing plant itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
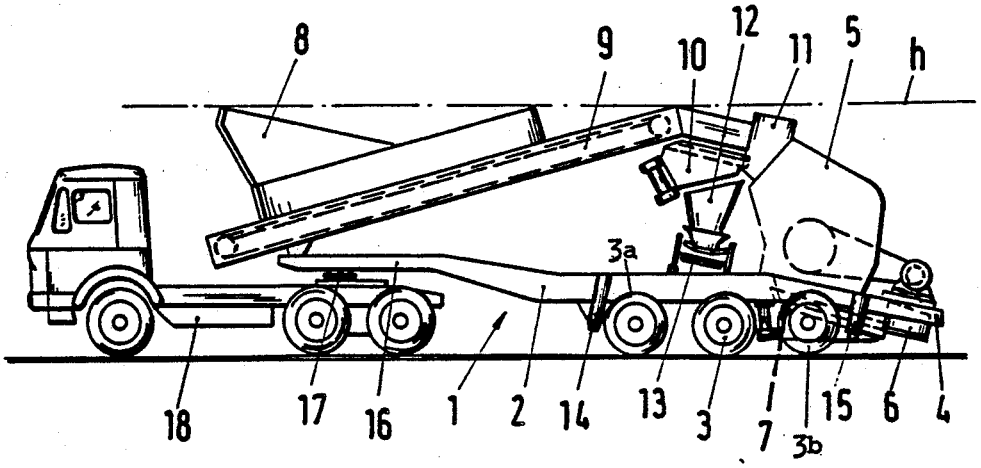
FIG. 1 is an elevational view of a mobile crushing plant which embodies the invention, the front portion of the frame being attached to the bed of a towing vehicle and the wheels on the frame being in contact with the ground.
Figure 2:
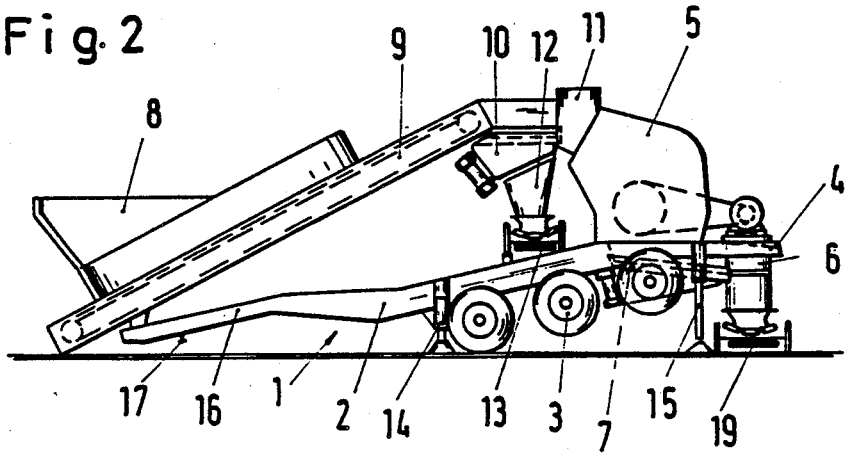
FIG. 2 illustrates the crushing plant in actual use with the comminuting machine on the rear portion of the frame at a maximum distance from the ground and with the inlet of the feeding unit close to the ground.

The improved mobile crushing plant 1 which is shown in FIGS. 1 and 2 comprises an elongated frame 2 mounted on three sets of ground- or road-contacting wheels 3, 3*a*, 3*b* and having a rear end portion 4 beneath a crushing or comminuting machine 5, such as an impact pulverizer which may be of the type manufactured and distributed by the assignee of the present application. The front end portion 16 of the frame 2 can be mounted on the flat bed of a towing vehicle 18 by means of a fifth wheel 17 so that the entire crushing plant 1 can be transported to or from a locale of use. A tubular outlet 6 for comminuted material receives such material from the discharge end of the comminuting machine 5 by means of a suitable conveyor 7, e.g., a vibratory conveyor. The receiving end of the conveyor 7 is located beneath the comminuting machine 5, and the outlet 6 is disposed behind the main portion of the machine, i.e., nearer to the rear portion 4.

The unit which serves to feed material to be comminuted to the machine 5 comprises an elongated endless belt or chain conveyor 9 having a discharge end at a level above the machine 5 and an intake end beneath a funnel-shaped inlet 8 which is mounted at a level above the front end portion 16 of the frame 2 so that it overlies the bed of the towing vehicle 18 when the plant is not in use. The conveyor 9 may but need not have buckets to transport material from the inlet 8 to the comminuting machine 5. Actually, the discharge end of the conveyor 9 delivers the material to a sieve 10. That portion of the supplied material which overflows the sieve 10 enters the comminuting machine 5 by way of a tubular guide 11 or any other suitable material admitting means. The smaller particles of supplied material penetrate through the interstices of the sieve 10 and descend in a funnel-shaped duct or chute 12 to be deposited on the upper reach of a first take-off conveyor 13. The latter can advance the material at right angles to the plane of FIG. 1 or 2.

The frame 2 further carries a set of hydraulically or otherwise operated jacks 14 which are located immediately in front of the foremost set of wheels 3*a* and can be extended or retracted between the positions shown in FIGS. 2 and 1, respectively. The lower portions of the jacks 14 can move into actual contact with the ground and they together constitute a fulcrum defining a horizontal pivot axis which extends transversely of the frame 2, i.e., in parallelism with the axes of the sets of wheels 3, 3*a* and 3*b*.

A second set of hydraulic or otherwise operated extendable and contractible jacks 15 is provided immediately behind the rearmost set of wheels 3*b*. These jacks are actuated to assume the extended positions of FIG. 2 when the upper half of the fifth wheel 17 is detached from the half on the towing vehicle 18 at the locale of use of the crushing plant 1 and the entire crushing plant is to be tilted about the aforementioned horizontal pivot axis which is defined by the lower end portions of the jacks 14 so that the inlet 8 is lowered from the first position of FIG. 1 to the second position of FIG. 2 and the comminuting machine 5 is simultaneously raised from the first position of FIG. 1 to the second position of FIG. 2. In such second position, the machine 5 is located at a sufficient distance from the ground so that a second take-off conveyor 19 can be placed beneath the outlet 6 to receive material which is comminuted in the machine 5 and is delivered to the outlet 6 by the vibratory conveyor 7.

It will be noted that, when the crushing plant 1 is properly hitched to the towing vehicle 18, the rear end portion 4 (which is inclined with reference to the median portion of the frame 2) slopes downwardly so that the machine 5 is even closer to the ground, i.e., to the surface of a road when the towing vehicle 18 is in motion. On the other hand, the front end portion 16 is somewhat offset upwardly with reference to the median portion of the frame 2 so as to ensure that such front end portion can overlie the bed of the vehicle 18 when the crushing plant 1 is ready to be transported to or from a locale of use and the frame 2 assumes a first position which is shown in FIG. 1 and in which its front end portion 16 is located at a first distance from the ground. The maximum permissible height of the towing vehicle-crushing plant combination is shown at h. This height depends on the specifications in a particular country.

The operation is as follows:

When the towing vehicle 18 has completed the transport of the mobile crushing plant 1 to a selected location, the parts of the fifth wheel 17 are disconnected from each other so that the vehicle 18 can be driven away as soon as the front jacks 14 are actuated to lift the front end portion 16 of the frame 2 above and away from the bed of the vehicle. In the next step, the rear jacks 15 are actuated to pivot the entire frame 2 with reference to the horizontal axis at the lower ends of the front jacks 14 to a second position which is shown in FIG. 2 so that the inlet 8 is lowered as close to the ground as possible and the machine 5 is raised to its second position at a maximum distance from the ground. At such time, the front end portion 16 of the frame 2 is located at a lesser second distance from the ground. This provides room for introduction of the receiving end of the take-off conveyor 19 beneath the lower end of the outlet 6. As shown in FIG. 2, at least one set of wheels is or can be lifted above the ground when the crushing plant 1 is ready for use. The take-off conveyor 19 can constitute a mobile unit whose frame is mounted on one or more pairs of wheels so that it can be conveniently moved to and from the position of FIG. 2. The extended jacks 14 and 15 ensure that the crushing plant 1 is properly immobilized and stabilized in the position of use.

The width and the length of the plant 1 are preferably selected in such a way that it can be readily transported on public roads not unlike a reasonably large semi-trailer.

An important advantage of the improved mobile crushing plant is that actuation of the jacks 15 in a direction to raise the rear end portion 4 of the frame 2 not only entails a raising of the comminuting machine 5 above and away from the ground but that such actuation of the jacks 15 simultaneously results in a lowering of the inlet 8 of the material feeding or supplying unit 8–9 so that the inlet 8 is nearer to the ground and the material to be comminuted need not be lifted well above the ground in order to enter the inlet 8.

Another important advantage of the improved crushing plant is that the front jacks 14 can perform a number of useful functions including facilitating raising or lowering of the upper part of the fifth wheel 17 (depending upon whether the front portion 16 is to be coupled with or detached from the towing vehicle 18), stabilizing the crushing plant in actual use, and defining a pivot axis for tilting of the frame 2 between the positions of FIGS. 1 and 2.

As can be seen in FIGS. 1 and 2, the major part of the feeding or supplying unit including the inlet 8 and the conveyor 9 is located in front of the pivot axis which is defined by the extended front jacks 14. Therefore, the jacks 15 need not exert a large force in order to pivot the frame 2 from the position of FIG. 1 to that of FIG. 2. The front jacks 14 are preferably located close to the center of gravity of the crushing plant 1 which renders it possible to operate with smaller and weaker rear jacks 15. This is in contrast to the teaching of the aforediscussed German Utility Model No. 85 34 877. The plant which is disclosed in this publication is designed in such a way that the means for tilting the frame must be dimensioned to carry the weight of the entire comminuting machine as well as a large part of the weight of the material feeding unit. This is necessary because, when the tilting operation is completed, the tilting means must continue to lift the rear end portion of the frame in order to raise the comminuting machine to a level at which the springs between the wheels and the frame are not stressed and need not react to vibrations and/or other stray movements which develop when the crushing plant of the Utility Model is in use.

The difference between the length of front jacks 14 in extended and collapsed or retracted positions is selected with a view to ensure that the front end portion 16 and/or the parts mounted on the frame 2 in the region of the front end portion 16 will not contact the ground before the rear jacks 15 have completed the task of raising the comminuting machine 5 to the required level, i.e., so that an available take-off conveyor 19 can be moved to a position beneath the outlet 6.

The placing of front and rear jacks 14, 15 close to the wheels **3-3*b*** is desirable and advantageous in many instances because this enhances the mechanical advantage of the frame as a lever and contributes to compactness of the crushing plant.

FIG. 1 shows that the conveyor 9 of the material feeding unit is nearly or substantially horizontal when the front end portion 16 of the frame 2 is properly coupled to the towing vehicle 18. The sieve 10 is horizontal or substantially horizontal when the rear end portion 4 is lifted to assume the position of FIG. 2. This is achieved by causing the rear end portion 4 to slope downwardly with reference to the median portion of the frame 2.

The frame 2 acts not unlike a two-armed lever which is fulcrumed at 14 and one arm of which carries the feeding unit including the inlet 8 while the other arm carries the comminuting machine 5. Therefore, when the two-armed lever is tilted, the machine 5 rises if the inlet 8 descends and vice versa. This solves the problems of lowering the comminuting machine 5 during transport, of raising the machine in actual use and of lowering the inlet 8 in actual use of the improved mobile crushing plant without the need for devices which would tilt the material feeding unit with reference to the frame.

The comminuting machine 5 may but need not be similar to or identical with the impact crusher which is disclosed in commonly owned U.S. Pat. No. 4,077,035 granted Apr. 12, 1977 to Jürgen Stuttmann.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A mobile crushing plant, comprising a semitrailer including a frame having a front end and a rear end and including a set of ground-contacting wheels at said rear end, said frame having a first position in which said front end thereof is located at a first distance from the ground and is connectable to a towing vehicle, and a second position in which said front end is located at a second distance from the ground, said second distance being less than said first distance; a crushing machine mounted on said frame at said rear end; a feeding device mounted on said frame and including an inlet at said front end of said frame for material to be crushed and a conveyor for conveying the material to said crushing machine; lifting means mounted on said frame at said rear end, which lifting means lift said rear end so that said frame pivots from said first position to said second position and thereby displaces said front end and said inlet of said feeding device towards the ground; and support means mounted on said frame in front of said set of wheels and spaced apart from said crushing machine, said support means having a rest position clear of the ground and an operative position in contact with the ground, and said support means defining in said operative position a substantially horizontal axis which extends transverse to said frame and constitutes a pivot axis for pivoting of said frame from said first to said second position.

2. The crushing plant of claim 1, wherein said support means is extendable and retractible.

3. The crushing plant of claim 1, wherein said lifting means is located on said frame behind and near said set of wheels, said support means also being located near said set of wheels.

4. The crushing plant of claim 1, wherein said rear end of said frame has a portion which carries said crushing machine and said portion is inclined downward at an angle such that said portion is at least approximately horizontal in said second position of said frame.

* * * * *